US008416975B2

(12) United States Patent
Ho et al.

(10) Patent No.: US 8,416,975 B2
(45) Date of Patent: Apr. 9, 2013

(54) HEARING AID HOUSING

(75) Inventors: Wai Kit David Ho, Singapore (SG); Wee Haw Koo, Singapore (SG)

(73) Assignee: Siemens Medical Instruments Pte. Ltd., Singapore (SG)

( * ) Notice: Subject to any disclaimer, the term of this patent is extended or adjusted under 35 U.S.C. 154(b) by 0 days.

(21) Appl. No.: 12/936,230

(22) PCT Filed: Apr. 2, 2008 (Under 37 CFR 1.47)

(86) PCT No.: PCT/SG2008/000107
§ 371 (c)(1), (2), (4) Date: Mar. 21, 2011

(87) PCT Pub. No.: WO2009/123563
PCT Pub. Date: Oct. 8, 2009

(65) Prior Publication Data
US 2011/0222716 A1 Sep. 15, 2011

(51) Int. Cl.
*H04R 25/00* (2006.01)

(52) U.S. Cl.
USPC ..... 381/330; 381/322; 381/324

(58) Field of Classification Search ..... 381/322, 381/324, 325, 327–328, 330
See application file for complete search history.

(56) References Cited

U.S. PATENT DOCUMENTS

| | | | |
|---|---|---|---|
| 4,309,576 | A | 1/1982 | Corrigan |
| 5,530,763 | A | 6/1996 | Aebi et al. |
| 5,708,720 | A | 1/1998 | Meyer |
| 6,041,128 | A | 3/2000 | Narisawa et al. |
| 2003/0094355 | A1 | 5/2003 | Angst |
| 2007/0086611 | A1 | 4/2007 | Rafferty |
| 2007/0140516 | A1 | 6/2007 | Fickweiler et al. |
| 2008/0165996 | A1 | 7/2008 | Saito et al. |
| 2010/0111341 | A1 | 5/2010 | Dittli et al. |

FOREIGN PATENT DOCUMENTS

| | | | |
|---|---|---|---|
| CH | 689685 | A5 | 8/1999 |
| DE | 10104129 | A1 | 8/2002 |
| EP | 0629101 | A1 | 12/1994 |
| EP | 0660641A1 | A1 | 6/1995 |
| JP | 9215098 | A | 8/1997 |
| JP | 1169498 | A | 3/1999 |
| WO | 2005051040 | A1 | 6/2005 |
| WO | 2006090545 | A1 | 8/2006 |
| WO | 2008015295 | A2 | 2/2008 |

OTHER PUBLICATIONS

PCT Written Opinion of the International Searching Authority dated Nov. 12, 2008.

*Primary Examiner* — Suhan Ni
(74) *Attorney, Agent, or Firm* — Laurence A. Greenberg; Werner H. Stemer; Ralph E. Locher

(57) ABSTRACT

In an embodiment, a hearing aid housing is provided. The hearing aid housing may include a first behind-the-ear hearing aid housing portion, a second behind-the-ear hearing aid housing portion, and a moisture protector at least partially arranged between the first behind-the-ear hearing aid housing portion and the second behind-the-ear hearing aid housing portion.

9 Claims, 2 Drawing Sheets

HEARING AID HOUSING

BACKGROUND OF THE INVENTION

Field of the Invention

Embodiments of the invention relate to a hearing aid housing.

A hearing aid is usually fit in or behind the ear of the user to amplify the sound for the user. Some popular types of hearing aids include behind-the-ear (BTE) aids, in the ear (ITE) aids, in the canal (ITC) aids, completely in the canal (CIC) aids, etc.

The hearing aid usually includes a hearing aid housing, within which a microphone for collecting sound waves, a signal processing circuit (also referred to as speech processing circuit) for processing the collected sound waves, and a loudspeaker (which may also be referred to as a receiver in the field of hearing aids) may be accommodated.

As the hearing aid housing is usually not an integral housing, it is easier for moisture, e.g. water or sweat from users, to flow into the haring aid housing, thereby damaging the circuits or components inside the hearing aid housing.

Senso-coating may be used to prevent moisture from flowing into the hearing aid housing. However, it is hard to apply it to every inch of the hearing aid housing. In another approach, a humidity proved battery may be used. However, in this case, it is usually not possible to make sure that each user of the hearing aid actually uses a humidity proved battery.

BRIEF SUMMARY OF THE INVENTION

Embodiments of the invention provide a moisture protected hearing aid in an easy and cost-effective manner.

An embodiment of the invention relates to a hearing aid housing. The hearing aid housing may include a first behind-the-ear hearing aid housing portion, a second behind-the-ear hearing aid housing portion, and a moisture protector at least partially arranged between the first behind-the-ear hearing aid housing portion and the second behind-the-ear hearing aid housing portion. It should be mentioned that in various embodiments, the hearing aid housing may include more than the mentioned two behind-the-ear hearing aid housing portion, e.g. three, four, five or even more.

By providing a moisture protector configured to be at least partially arranged between the first behind-the-ear hearing aid housing portion and the second behind-the-ear hearing aid housing portion, the hearing aid housing is protected from moisture, such as water or sweat from the user, so that the electrical and/or mechanical components within the hearing aid housing may be protected from damage by the moisture.

In an embodiment, the first behind-the-ear hearing aid housing portion and/or second behind-the-ear hearing aid housing portion may be made of plastic, which is, e.g. light and convenient for the user to wear.

The moisture protector may be clamped between the first behind-the-ear hearing aid housing portion and the second behind-the-ear hearing aid housing portion. For example, there may be a gap between the first behind-the-ear hearing aid housing portion and the second behind-the-ear hearing aid housing portion, and the moisture protect may be configured to fit in the gap in order to prevent moisture from the hearing aid housing. The moisture protect may be fixed between the first behind-the-ear hearing aid housing portion and the second behind-the-ear hearing aid housing portion by other suitable means as well, for example, using glue.

In an embodiment, the moisture protector may include flexible material, being of natural or synthetic origins, which can be deformed and after having been deformed and the stress removed, returns with force back into its original shape. For example, the moisture protector may include soft material, e.g. soft plastic material and/or rubber material. In another example, the moisture protector may include silicone. The moisture protector made of flexible material makes it easier to be fixed between the first behind-the-ear hearing aid housing portion and the second behind-the-ear hearing aid housing portion, without high requirement on the shape or dimension of the moisture protector in order to fill the gap between the first behind-the-ear hearing aid housing portion and the second behind-the-ear hearing aid housing portion.

It is noticed that the moisture protector may include a first portion made of inflexible material and a second portion made of flexible material as described above. For example, the first portion may be arranged to at least partially cover the gap between the first behind-the-ear hearing aid housing portion and the second behind-the-ear hearing aid housing portion, and the second portion is arranged to fill in the gap among the first portion, the first behind-the-ear hearing aid housing portion, and the second behind-the-ear hearing aid housing portion, which will be illustrated in the example below. The second portion may also include waterproof material to prevent moisture from flowing into the hearing aid housing.

In another embodiment, the moisture protector may include waterproof material such that when the moisture protector is arranged between the first behind-the-ear hearing aid housing portion and the second behind-the-ear hearing aid housing portion, the moisture protector may be configured to prevent water or moisture or sweat from passing through the gap between the first behind-the-ear hearing aid housing portion and the second behind-the-ear hearing aid housing portion. Some examples of waterproof material that may be included in the moisture protector include but are not limited to rubber, polyvinyl chloride (PVC), polyurethane (PU), silicone elastomer, etc.

According to an embodiment, the moisture protector has a shape configured such that it partially overlaps the outer surface of the first behind-the-ear hearing aid housing portion and the second behind-the-ear hearing aid housing portion. The overlapping portion of the moisture protector may, for example, help to prevent leaking of moisture from the lateral side of the gap between the first behind-the-ear hearing aid housing portion and the second behind-the-ear hearing aid housing portion.

In one example, the moisture protector may have a T-shape, such that one vertical edge of the T-shape moisture protector is inserted into the gap between the first behind-the-ear hearing aid housing portion and the second behind-the-ear hearing aid housing portion, and the other horizontal edge is arranged to partially overlap the outer surface of the first behind-the-ear hearing aid housing portion and the second behind-the-ear hearing aid housing portion.

In another example, the moisture protector may have a double T-shape. The vertical edge of the double T-shape moisture protector is clamped in the gap between the first behind-the-ear hearing aid housing portion and the second behind-the-ear hearing aid housing portion. The other two horizontal edges are arranged to partially overlap the outer surface and the inner surface of the first behind-the-ear hearing aid housing portion and the second behind-the-ear hearing aid housing portion, respectively.

In other embodiments, the moisture protector may have any other shape which is suitable to be arranged between the first behind-the-ear hearing aid housing portion and the second behind-the-ear hearing aid housing portion, and which is suitable to fit in the gap between the first behind-the-ear hearing aid housing portion and the second behind-the-ear hearing aid housing portion.

According to an embodiment, the moisture protector may be arranged substantially at least along one longitudinal side of the first behind-the-ear hearing aid housing portion and/or the second behind-the-ear hearing aid housing portion. For example, the first behind-the-ear hearing aid housing portion and the second behind-the-ear hearing aid housing portion may be joined together along the longitudinal side of each housing portion, which may induce a gap between two housing portions. The moisture protector arranged along the longitudinal side of the first and the second behind-the-ear hearing aid housing portions may help to fill in such a gap.

In another embodiment, the moisture protector may be arranged substantially at least along one face side of the first behind-the-ear hearing aid housing portion and/or the second behind-the-ear hearing aid housing portion.

In other embodiments of the invention, the moisture protector may be arranged along both the longitudinal side and the face side of the first behind-the-ear hearing aid housing portion and/or the second behind-the-ear hearing aid housing portion, so as to protect the entire hearing aid housing from moisture. The moisture protector may also be arranged partially along the longitudinal and/or face side of the first behind-the-ear hearing aid housing portion and/or the second behind-the-ear hearing aid housing portion, such that a part of the hearing aid housing which is more vulnerable to moisture, e.g. the part of the hearing aid contacting the ear, may be protected from moisture.

According to an embodiment, the moisture protector may include a hole, e.g. a through hole (in an alternative example, a blind hole may be provided), designed to receive at least a part of a peripheral component, such that at least part of the microphone is located within the first behind-the-ear hearing aid housing portion and the second behind-the-ear hearing aid housing portion. In an embodiment of the invention, a peripheral component may include e.g. a microphone, a volume control component, a button such as e.g. a push button, a switch, other peripheral components for controlling the hearing aid or one or more components of the hearing aid.

In one example, a microphone may be at least partially inserted into the hole, e.g. the through hole or the blind hole. In another example, the microphone may be completely inserted into the hole. The microphone may be arranged such that the diaphragm of the microphone is at or close to the hole in order to receive sound waves.

In a further embodiment, a waterproof flexible microphone cover may be included to cover the through hole. The waterproof flexible microphone cover may thus protect the microphone from moisture.

In one embodiment, the hearing aid housing as described above may further include at least one of the following components: a signal processing circuit (also referred to as speech processing circuit) for processing electrical signal (generated from the collected sound waves by the at least one microphone), a loudspeaker (also referred to as a receiver or a transducer) for outputting sound waves generated from the processed electrical signal, an amplifying circuit for amplifying the signal to be transmitted to the loudspeaker, a volume control circuit to control the degree of amplification provided by an amplifying circuit, a battery chamber for accommodating a battery, and any other circuits or components which may be used or needed in a hearing aid.

BRIEF DESCRIPTION OF THE SEVERAL VIEWS OF THE DRAWING

In the drawings, like reference characters generally refer to the same parts throughout the different views. The drawings are not necessarily to scale, emphasis instead generally being placed upon illustrating the principles of the invention. In the following description, various embodiments of the invention are described with reference to the following drawings, in which.

DESCRIPTION OF THE INVENTION

Figure 1:
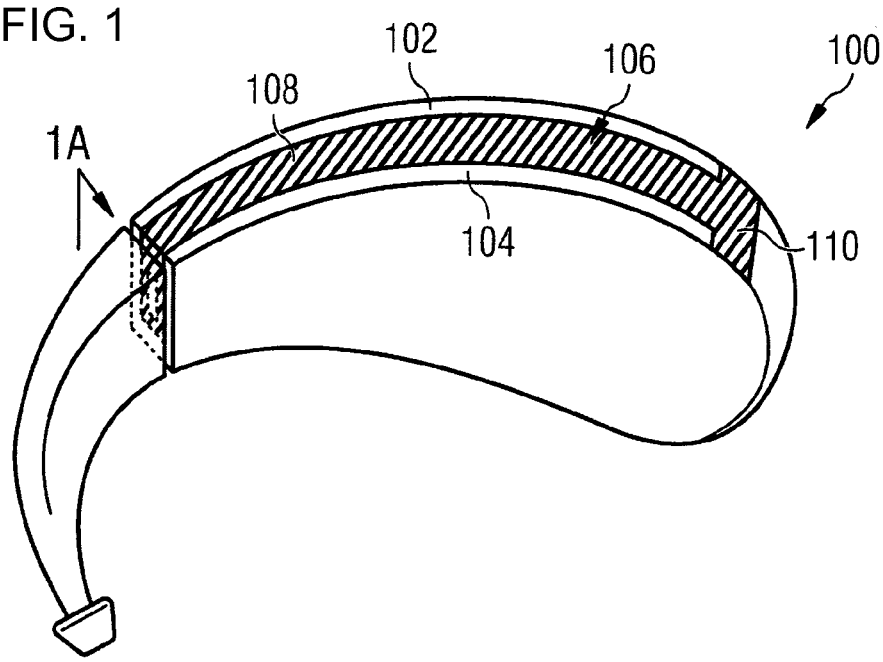
FIG. 1 shows a hearing aid housing according to an embodiment of the invention.

FIG. 1 shows a hearing aid housing 100 according to an embodiment of the invention. The hearing aid housing 100 includes a first behind-the-ear hearing aid housing portion 102, a second behind-the-ear hearing aid housing portion 104, and a moisture protector 106 at least partially arranged between the first behind-the-ear hearing aid housing portion 102 and the second behind-the-ear hearing aid housing portion 104.

The moisture protector 106, being at least partially arranged between the first behind-the-ear hearing aid housing portion 102 and the second behind-the-ear hearing aid housing portion 104, may protect the hearing aid housing 100, e.g. the electrical and/or mechanical components within the hearing aid housing 100, from moisture, such as water or sweat from the user.

In an embodiment, the first behind-the-ear hearing aid housing portion 102 and/or second behind-the-ear hearing aid housing portion 104 may be made of plastic.

The moisture protector 106 may be clamped between the first behind-the-ear hearing aid housing portion 102 and the second behind-the-ear hearing aid housing portion 104. The moisture protect 106 may also be fixed between the first behind-the-ear hearing aid housing portion 102 and the second behind-the-ear hearing aid housing portion 104 by other suitable means, such as by gluing.

The moisture protector 106 may be arranged substantially at least along one longitudinal side 108 of the first behind-the-ear hearing aid housing portion 102 and/or the second behind-the-ear hearing aid housing portion 104.

In another embodiment, the moisture protector 106 may be arranged substantially at least along one face side 110 of the first behind-the-ear hearing aid housing portion 102 and/or the second behind-the-ear hearing aid housing portion 104.

According to the embodiment as shown in FIG. 1, the moisture protector 106 is arranged along both the longitudinal side 108 and the face side 110 of the first behind-the-ear hearing aid housing portion 102 and/or the second behind-the-ear hearing aid housing portion 104, such that part of the hearing aid housing 100 which is more vulnerable to moisture, e.g. the part of the hearing aid 100 contacting the ear, may be protected from moisture.

The moisture protector 106 may have a shape configured such that it partially overlaps the outer surface of the first behind-the-ear hearing aid housing portion 102 and the second behind-the-ear hearing aid housing portion 104, e.g. as shown in FIG. 1. The overlapping portion of the moisture protector 106 with the outer surface of the first behind-the-ear hearing aid housing portion 102 and/or the second behind-the-ear hearing aid housing portion 104 may help to prevent leaking of moisture from the lateral side of the gap between the first behind-the-ear hearing aid housing portion 102 and the second behind-the-ear hearing aid housing portion 104. A cross-section view of the moisture protector 106 along the direction 1A (see FIG. 1) is shown in FIG. 2.

Figure 2:
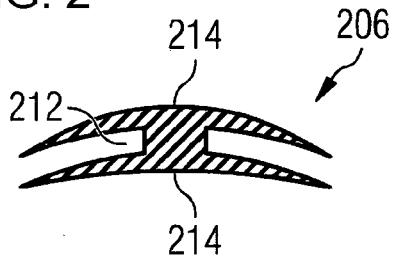
FIGS. 2 and 3 show a cross-section view and a 3-dimensional view of a moisture protector according to an embodiment.
Figure 3:
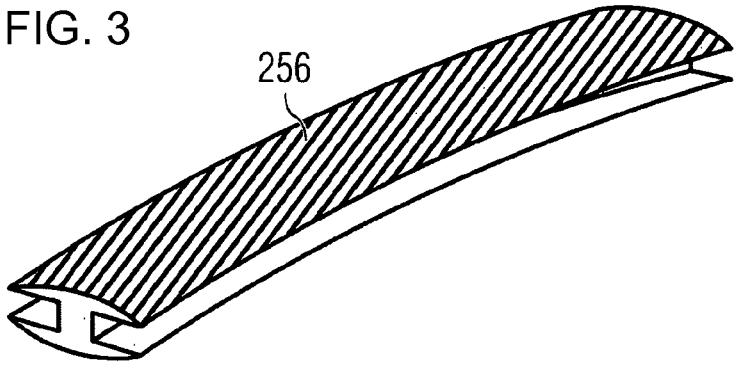

As shown in FIG. 2, the cross-section of the moisture protector 206 has a double T-shape. A 3-dimensional view of the double T-shape moisture protector 256 is shown in FIG. 3.

The vertical edge 212 of the double T-shape moisture protector 206 may be clamped in the gap between a first behind-the-ear hearing aid housing portion and a second behind-the-ear hearing aid housing portion. The other two horizontal edges 214 are arranged to partially overlap the outer surface and, optionally, the inner surface of the first behind-the-ear hearing aid housing portion and the second behind-the-ear hearing aid housing portion, respectively.

The moisture protector 106, 206, 256 above may have other suitable shapes, such as a T-shape, which are suitable to fit in the gap between a first behind-the-ear hearing aid housing portion and a second behind-the-ear hearing aid housing portion.

The moisture protector 106, 206, 256 described above may include flexible material, such as soft plastic material and/or rubber material and/or silicone. The moisture protector 106, 206, 256 made of flexible material makes it easier to be fixed between a first behind-the-ear hearing aid housing portion and a second behind-the-ear hearing aid housing portion, decreasing the requirement on the accuracy of the shape or dimension of the moisture protector 106, 206, 256 in order to fill the gap between the first behind-the-ear hearing aid housing portion and the second behind-the-ear hearing aid housing portion.

In another embodiment, the moisture protector 106, 206, 256 may include waterproof material, such as rubber, polyvinyl chloride (PVC), polyurethane (PU) and silicone elastomer, to prevent water or moisture or sweat from passing through the gap between a first behind-the-ear hearing aid housing portion and a second behind-the-ear hearing aid housing portion.

Figure 4:
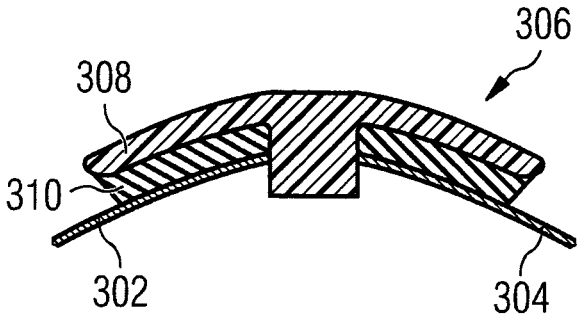
FIG. 4 shows a moisture protector according to another embodiment of the invention.

FIG. 4 shows a moisture protector 306 according to another embodiment of the invention.

The moisture protector 306 is arranged at least partially between a first behind-the-ear hearing aid housing portion 302 and a second behind-the-ear hearing aid housing portion 304.

The moisture protector 306 may include a first portion 308 made of inflexible material and a second portion 310 made of flexible material as described above. For example, the first portion 306 may be arranged to at least partially cover the gap between the first behind-the-ear hearing aid 302 housing portion and the second behind-the-ear hearing aid housing portion 304, and the second portion 310 is arranged to fill in the gap among the first portion 308, the first behind-the-ear hearing aid housing portion 302, and the second behind-the-ear hearing aid housing portion 304.

The second portion 310 may also include waterproof material to prevent moisture, e.g. from the lateral side of the gap between the first housing portion 302 and the second housing portion 304 as shown in FIG. 3, from leaking into the hearing aid housing.

Figure 5:
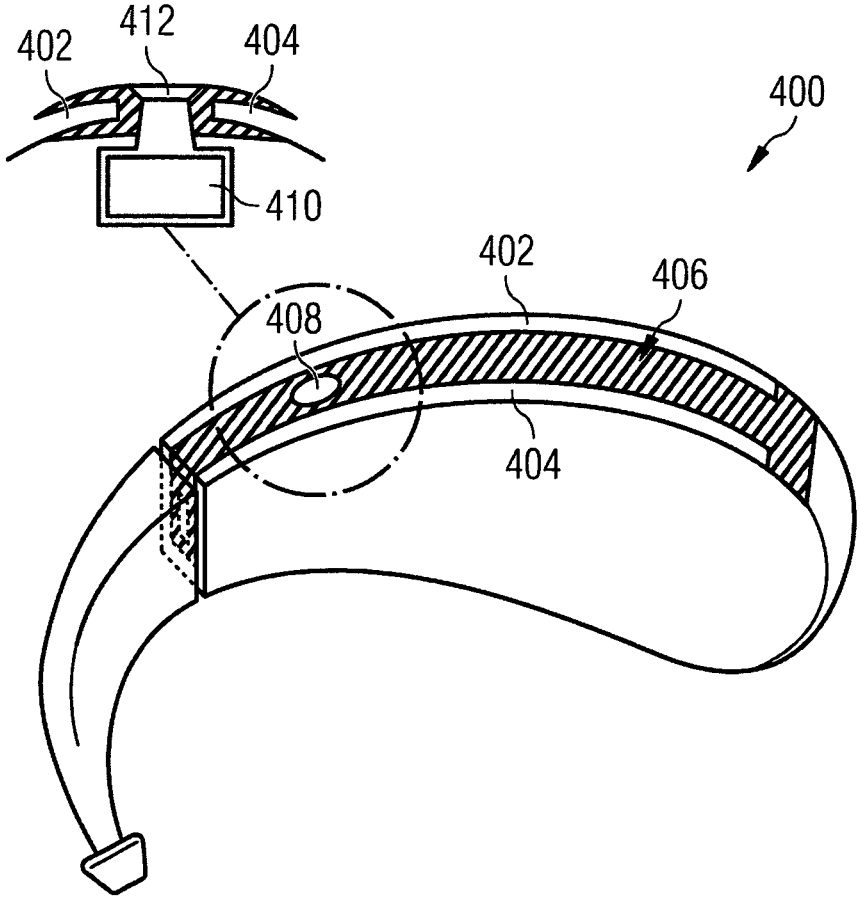
FIG. 5 shows a hearing aid housing according to an embodiment of the invention.

FIG. 5 shows a hearing aid housing 400 according to another embodiment of the invention.

The hearing aid housing 400 includes a first behind-the-ear hearing aid housing portion 402, a second behind-the-ear hearing aid housing portion 404, and a moisture protector 406 at least partially arranged between the first behind-the-ear hearing aid housing portion 402 and the second behind-the-ear hearing aid housing portion 404.

The moisture protector 406 may include a through hole 408 designed to receive at least a part of a microphone 410, such that at least part of the microphone 410 is located within the first behind-the-ear hearing aid housing portion 402 and the second behind-the-ear hearing aid housing portion 404.

For example, a microphone 410 may be at least partially inserted into the through hole 408. The microphone 410 may be arranged such that the diaphragm 412 of the microphone 410 is at or close to the through hole 408 in order to receive sound waves. The diaphragm 412 may be integrated into the moisture protector 406 in an embodiment.

In a further embodiment, a waterproof flexible microphone cover (not shown) may be included to cover the through hole 408, e.g. to also cover the diaphragm 412 of the microphone 410, in order to protect the microphone 410 from moisture.

The hearing aid housing 100, 400 as described above may further include at least one of the following components (not shown in FIGS. 1 and 5): a signal processing circuit, a loudspeaker, an amplifying circuit, a volume control circuit, a battery chamber, and any other circuits or components which may be used or needed in a hearing aid.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

The invention claimed is:

1. A hearing aid housing, comprising:

a first behind-the-ear, in-the-ear, in-the-canal or completely-in-the-canal hearing aid housing portion;

a second behind-the-ear, in-the-ear, in-the-canal or completely-in-the-canal hearing aid housing portion; and a moisture protector at least partially disposed between said first hearing aid housing portion and said second hearing aid housing portion, said moisture protector having a T-shape configured for partially overlapping an outer surface of said first hearing aid housing portion and an outer surface of said second hearing aid housing portion;

said moisture protector being disposed substantially at least along one longitudinal side of said first hearing aid housing portion and/or said second hearing aid housing portion.

2. The hearing aid housing according to claim 1, wherein at least one of said first hearing aid housing portion or said second hearing aid housing portion is made of plastic.

3. The hearing aid housing according to claim 1, wherein said moisture protector is clamped between said first hearing aid housing portion and said second hearing aid housing portion.

4. The hearing aid housing according to claim 1, wherein said moisture protector is formed of soft material.

5. The hearing aid housing according to claim 4, wherein said soft material is at least one of soft plastic material or rubber material.

6. The hearing aid housing according to claim 1, wherein said moisture protector has a shape configured to partially overlap an outer surface of said first hearing aid housing portion and an outer surface of said second hearing aid housing portion.

7. The hearing aid housing according to claim 1, which further comprises a microphone at least partially inserted into said through hole.

8. A hearing aid housing, comprising:

a first behind-the-ear, in-the-ear, in-the-canal or completely-in-the-canal hearing aid housing portion;

a second behind-the-ear, in-the-ear, in-the-canal or completely-in-the-canal hearing aid housing portion; and a moisture protector at least partially disposed between said first hearing aid housing portion and said second hearing aid housing portion, said moisture protector having a double T-shape configured for partially overlapping an outer surface of said first hearing aid housing portion and an outer surface of said second hearing aid housing portion;

said moisture protector being disposed substantially at least along one longitudinal side of said first hearing aid housing portion and/or said second hearing aid housing portion.

9. The hearing aid housing according to claim 7, which further comprises a waterproof flexible microphone cover covering said through hole.

* * * * *